US011286124B2

(12) United States Patent
Kannari

(10) Patent No.: US 11,286,124 B2
(45) Date of Patent: Mar. 29, 2022

(54) SHEET FEEDING DEVICE AND IMAGE FORMING APPARATUS

(71) Applicant: CANON KABUSHIKI KAISHA, Tokyo (JP)

(72) Inventor: Isao Kannari, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/944,372

(22) Filed: Jul. 31, 2020

(65) Prior Publication Data

US 2021/0047139 A1 Feb. 18, 2021

(30) Foreign Application Priority Data

Aug. 13, 2019 (JP) ..... JP2019-148621

(51) Int. Cl.
*B65H 1/04* (2006.01)

(52) U.S. Cl.
CPC ..... *B65H 1/04* (2013.01); *B65H 2402/31* (2013.01); *B65H 2402/45* (2013.01); *B65H 2403/5331* (2013.01); *B65H 2405/11162* (2013.01); *B65H 2405/324* (2013.01); *B65H 2407/21* (2013.01); *B65H 2511/214* (2013.01); *B65H 2601/11* (2013.01); *B65H 2601/321* (2013.01); *B65H 2801/06* (2013.01)

(58) Field of Classification Search
CPC ..... B65H 2407/21; B65H 2405/11162; B65H 2402/45; B65H 2405/324; B65H 2403/5331; G03G 15/6514
See application file for complete search history.

(56) References Cited

U.S. PATENT DOCUMENTS

| | | | | |
|---|---|---|---|---|
| 8,480,074 | B2 | 7/2013 | Ubayashi et al. | |
| 8,857,812 | B2 * | 10/2014 | Yamamoto | B65H 1/04 271/162 |
| 9,540,192 | B2 | 1/2017 | Kannari | |
| 10,059,540 | B2 * | 8/2018 | Tateishi | B65H 1/04 |
| 10,800,620 | B2 * | 10/2020 | Kannari | B65H 1/04 |
| 2011/0266743 | A1 | 11/2011 | Yamamoto | |

* cited by examiner

*Primary Examiner* — Jeremy R Severson
(74) *Attorney, Agent, or Firm* — Venable LLP

(57) ABSTRACT

A sheet feeding device includes a casing; a door rotatable relative to the casing; a tray configured to stack a sheet thereon and rotatable between a closed position where the tray is closed to the casing, a first open position where the tray opens relative to the casing at a first angle, and a second open position where the tray opens relative to the casing at a second angle larger than the first angle; and a sheet feeding unit provided in the casing and configured to feed the sheet stacked on the tray being in the first position. When the door is opened relative to the casing at an angle exceeding the first angle in a state in which the tray is in the first open position, the door moves the tray to the second open position.

13 Claims, 14 Drawing Sheets

(a)

(b)

(a)

(b)

(a)

(b)

(a)

(b)

SHEET FEEDING DEVICE AND IMAGE FORMING APPARATUS

FIELD OF THE INVENTION AND RELATED ART

The present invention relates to a sheet feeding device for feeding a sheet and to an image forming apparatus including the sheet feeding device.

A conventional image forming apparatus includes a manual feeding tray for feeding a sheet, stacked by a user, to an image forming portion. A roller for feeding the sheet stacked on the manual feeding tray decreases, in this embodiment, efficiency due to abrasion or deposition of paper powder. For that reason, when the number of sheets fed reaches a certain number, an exchanging operation of the roller is carried out. As such an image forming apparatus, U.S. Patent Application Publication No. US2011/0266743 discloses an image forming apparatus including a manual feeding tray provided so as to be capable of changing an angle of the manual feeding tray relative to an apparatus main assembly. In US2011/0266743, when a maintenance operation such as exchange of the roller is carried out, the manual feeding tray opens at an angle larger than an angle during feeding of the sheet. By this, accessibility to the roller is improved.

However, in US2011/0266743, the angle of the manual feeding tray relative to the apparatus main assembly cannot be maintained unless an external force is continuously applied to the manual feeding tray. For that reason, operativity during the maintenance operation decreases.

SUMMARY OF THE INVENTION

A principal object of the present invention is to provide a sheet feeding device improved in maintenance property and to provide an image forming apparatus including the sheet feeding device.

According to an aspect of the present invention, there is provided a sheet feeding device comprising: a casing; a door rotatable relative to the casing; a tray configured to stack a sheet thereon and rotatable between a closed position where the tray is closed to the casing, a first open position where the tray opens relative to the casing at a first angle, and a second open position where the tray opens relative to the casing at a second angle larger than the first angle; and a sheet feeding unit provided in the casing and configured to feed the sheet stacked on the tray being in the first position, wherein when the door is opened relative to the casing at an angle exceeding the first angle in a state in which the tray is in the first open position, the door moves the tray to the second open position.

Further features of the present invention will become apparent from the following description of exemplary embodiments with reference to the attached drawings.

Figure 2:
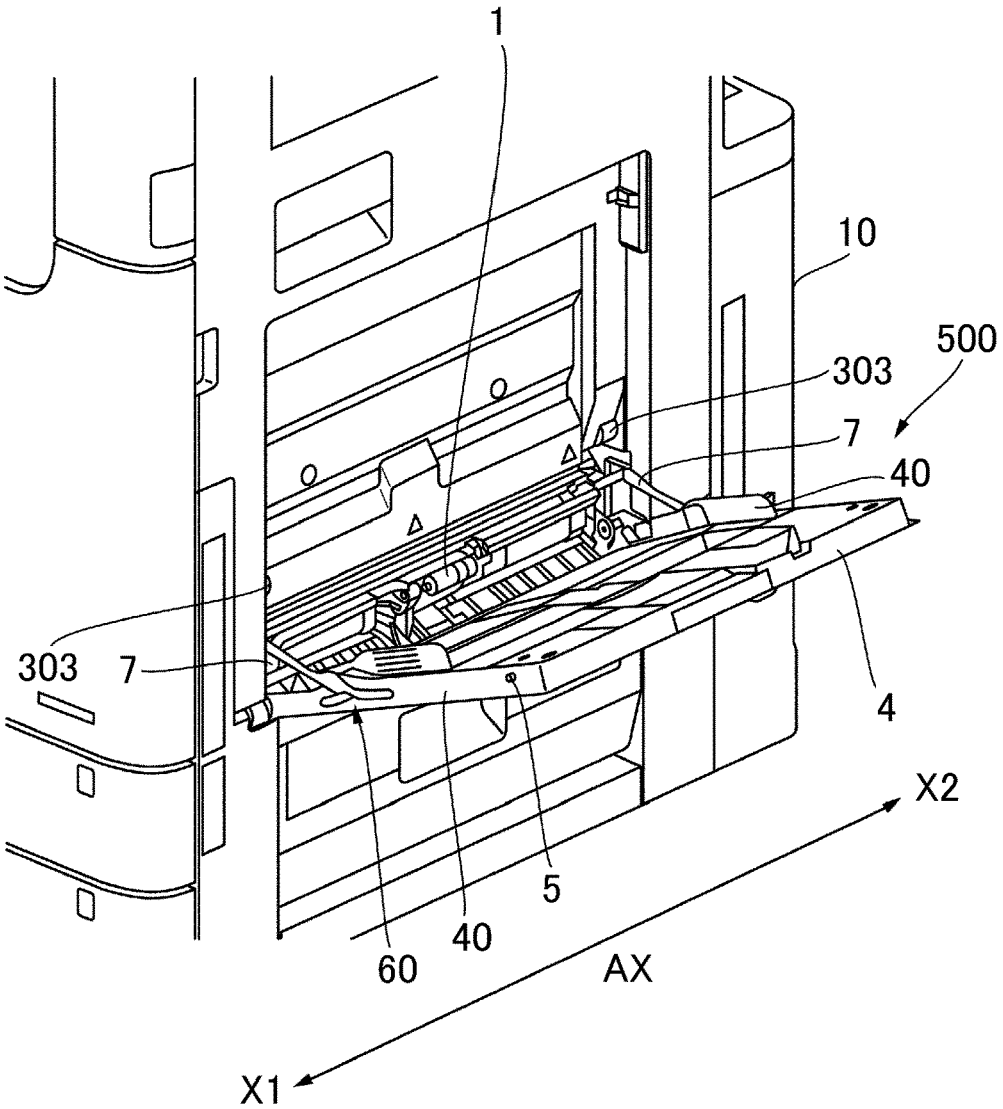
Figure 2:
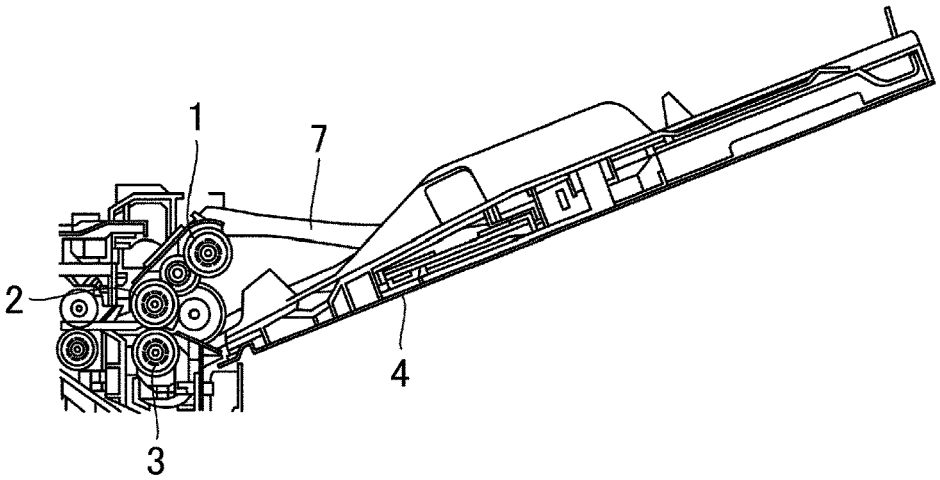

Part (a) of FIG. 2 is a perspective view of a manual feeding tray in a first open position, and part (b) of FIG. 2 is a partially sectional view of a sheet feeding device in the first open position.

Figure 3:
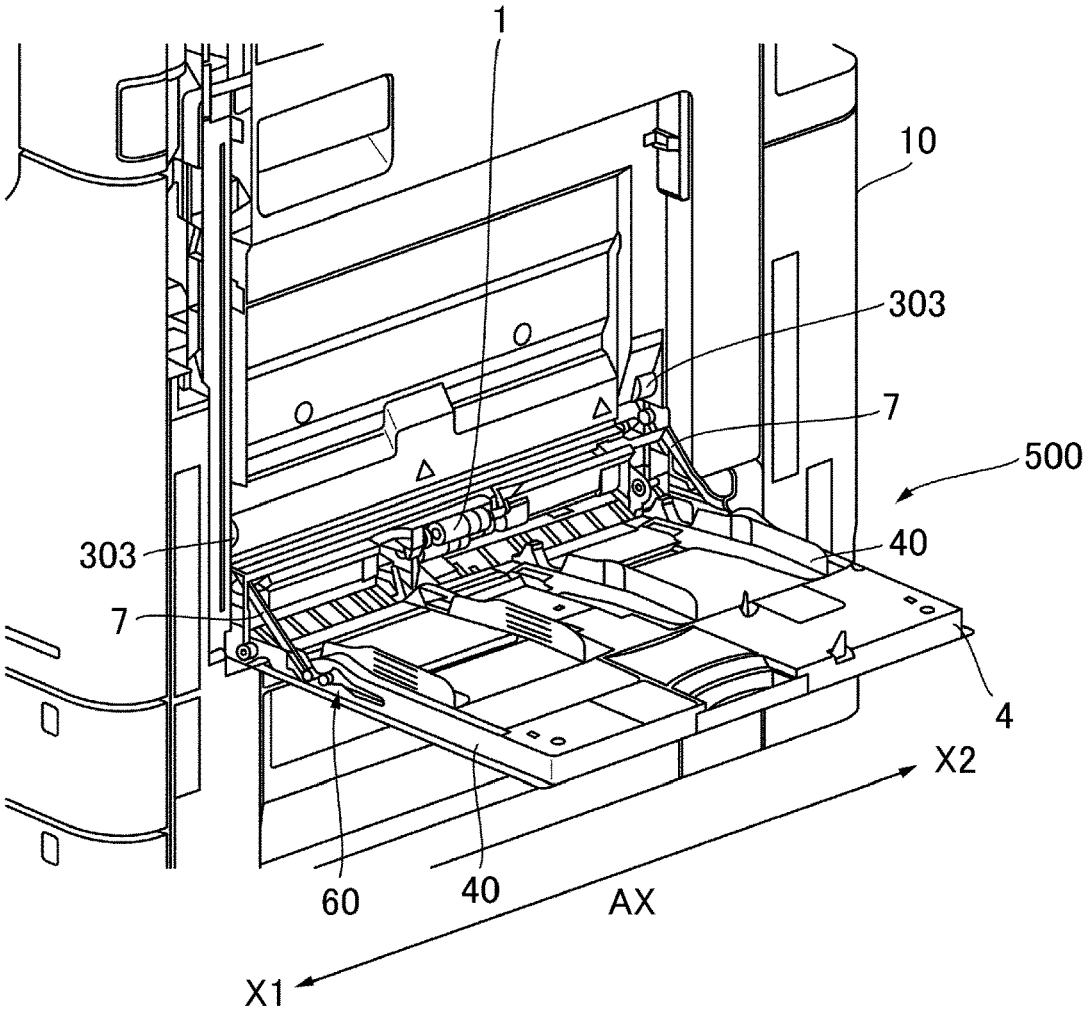
Figure 3:
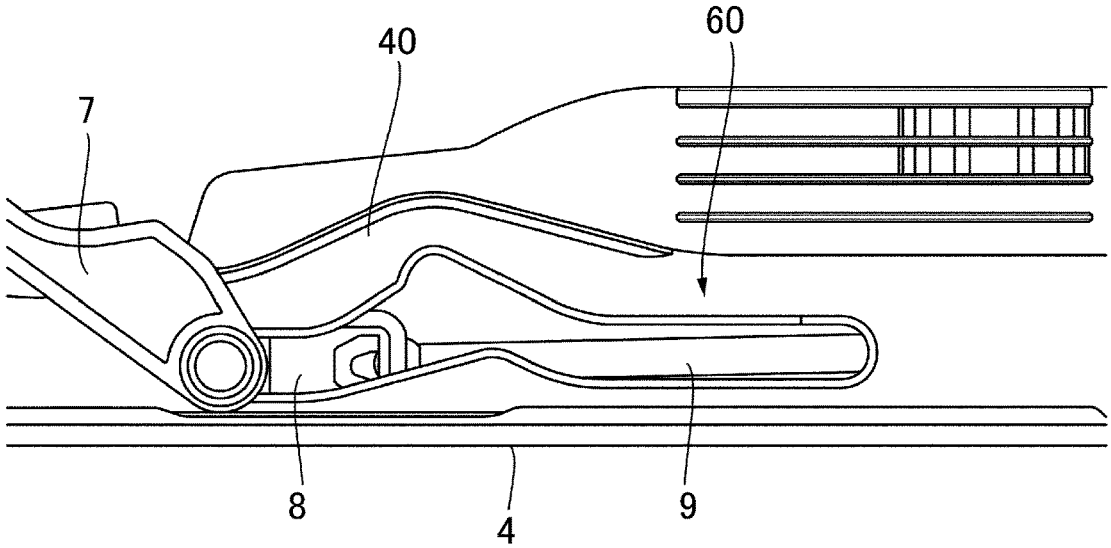

Part (a) of FIG. 3 is a perspective view of the manual feeding tray in a second open position, and part (b) of FIG. 3 is an enlarged side view of a principal portion of the manual feeding tray in the second open position.

Figure 4:
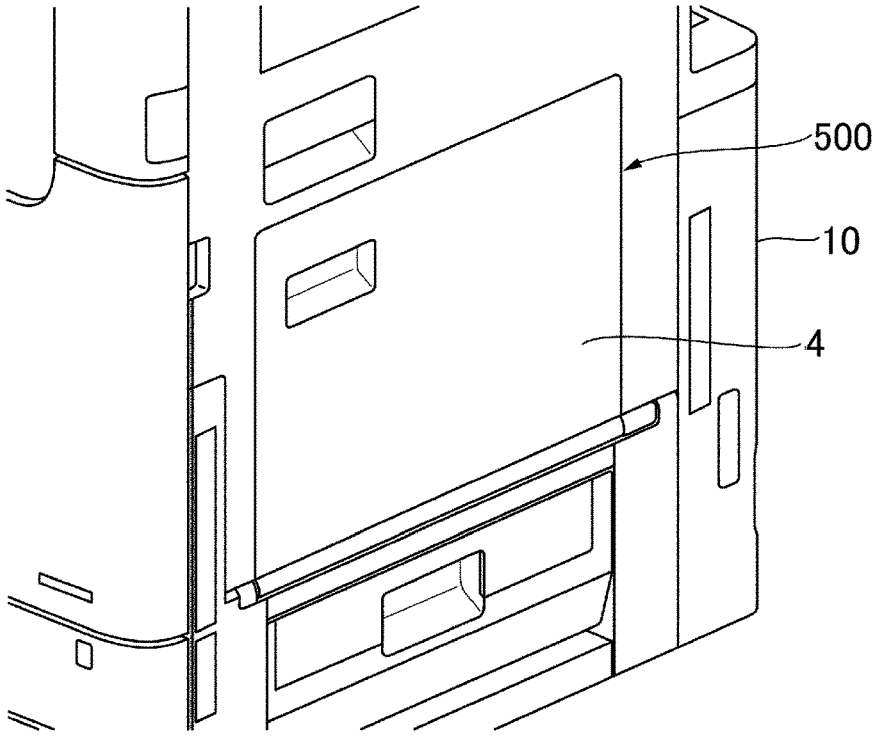
Figure 4:
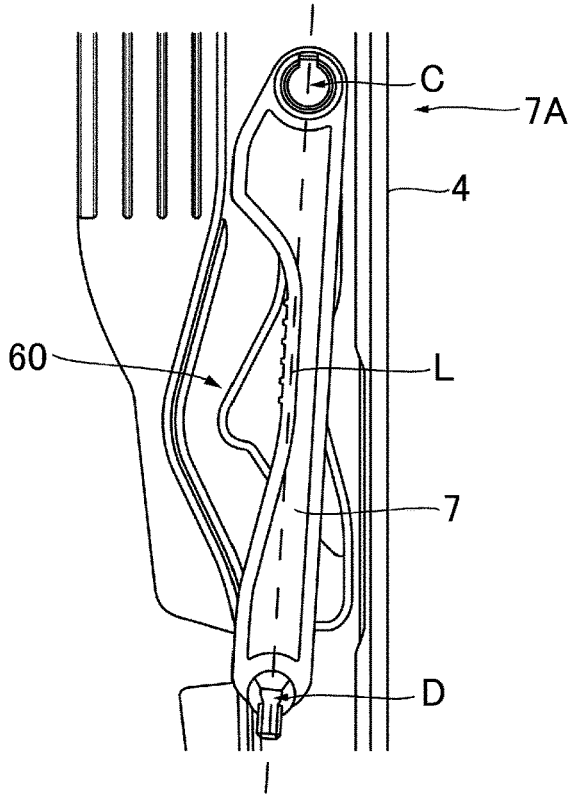

Part (a) of FIG. 4 is a perspective view of the manual feeding tray in a first closed state, and part (b) of FIG. 4 is an enlarged side view of a principal portion of the manual feeding tray including a first guiding passage and a second guiding passage in the first closed state.

Figure 5:
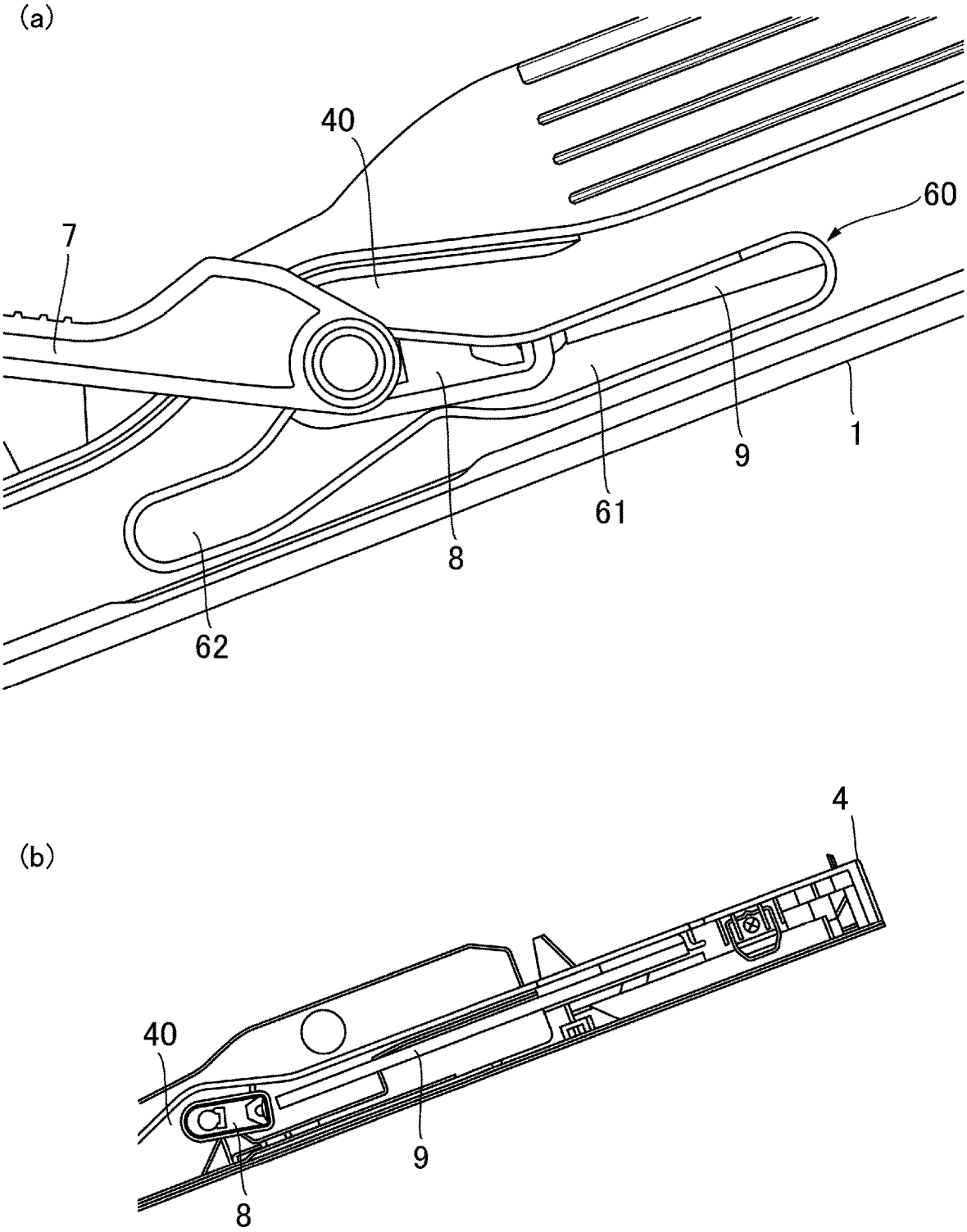

Part (a) of FIG. 5 is a side view of a principal portion of the manual feeding tray including a guiding portion in the first open position, and part (b) of FIG. 5 is a partially sectional view of the manual feeding tray in the first open position.

Figure 6:
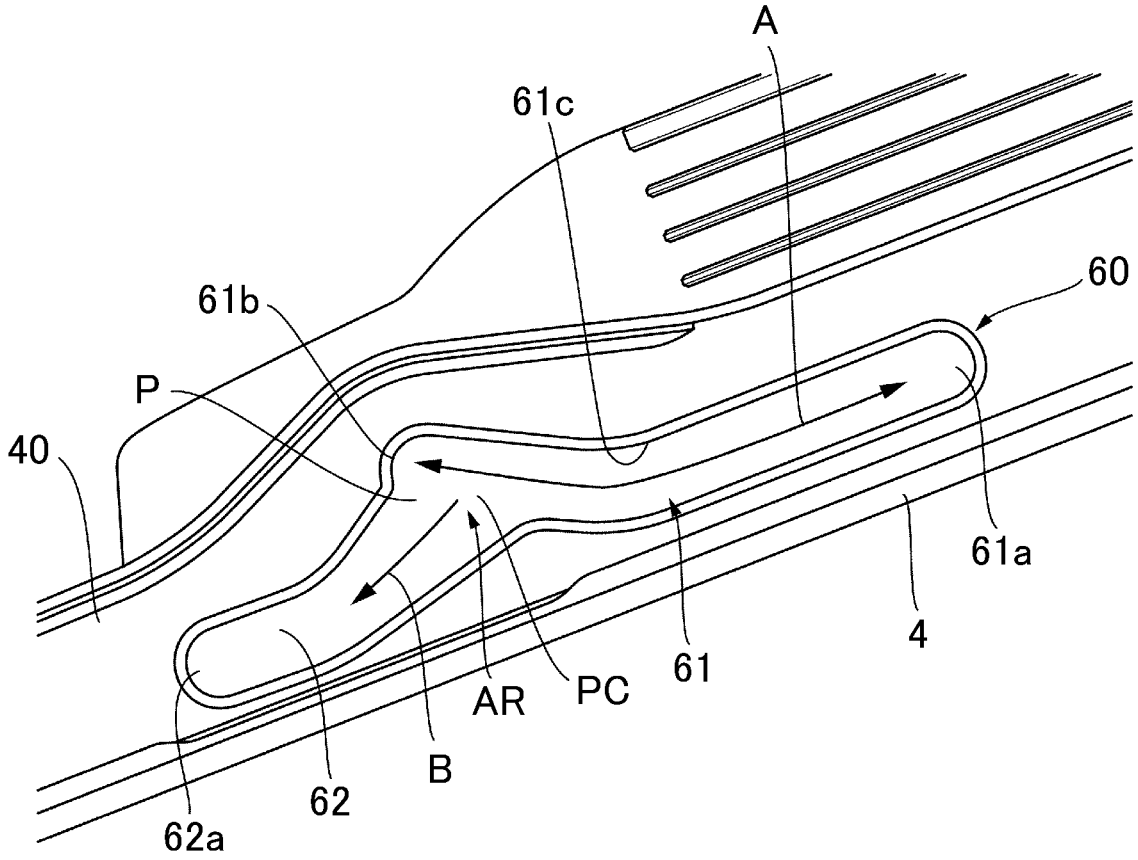

FIG. 6 is a schematic view for illustrating motion of a link portion.

Figure 7:
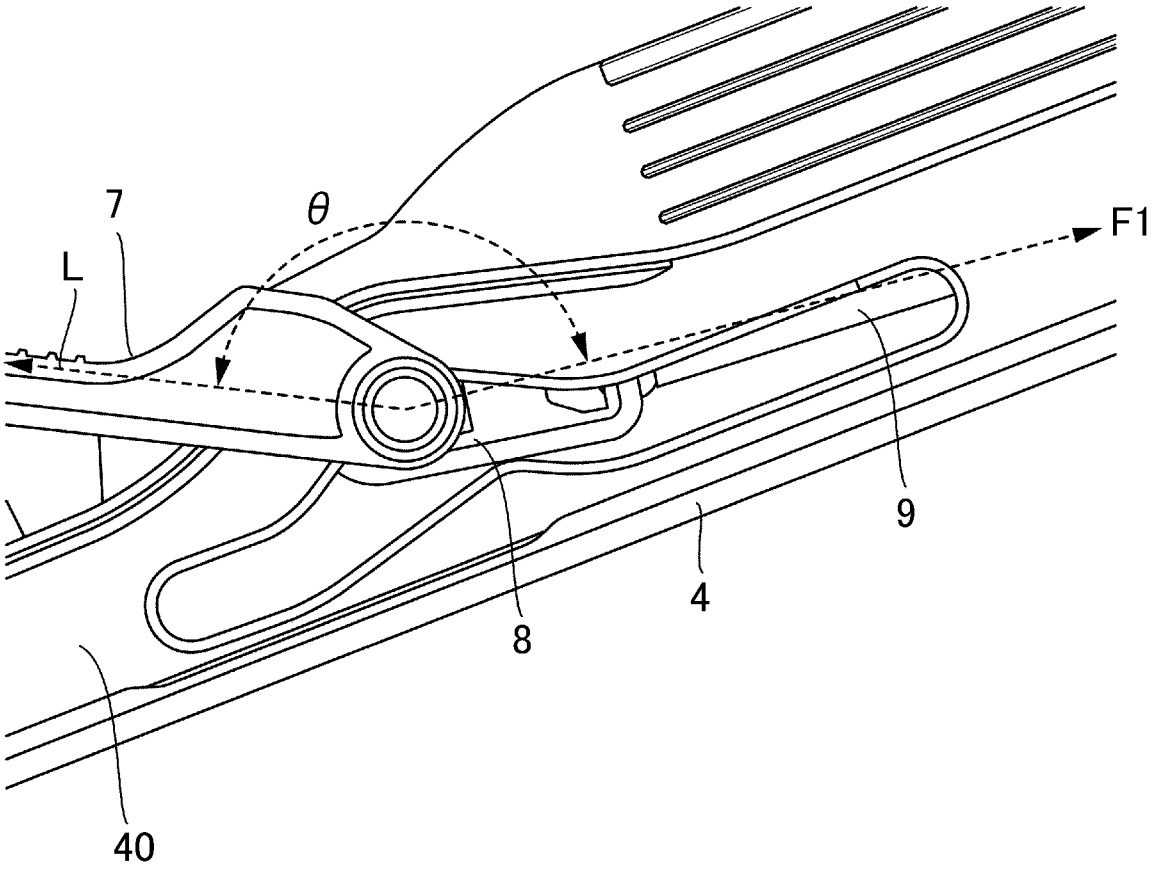

FIG. 7 is a schematic view for illustrating a direction of an urging force with which an urging member urges the link portion.

Figure 8:
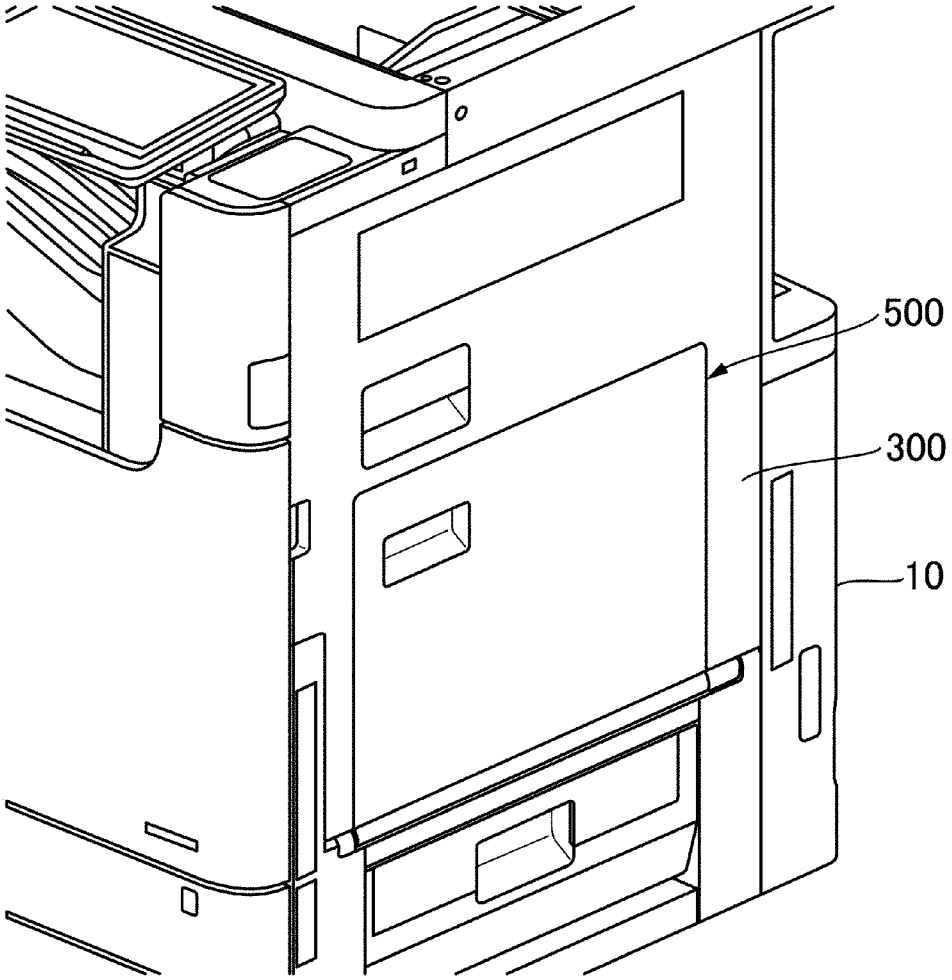

FIG. 8 is a schematic view showing the case where a door is in a closed state.

Figure 9:
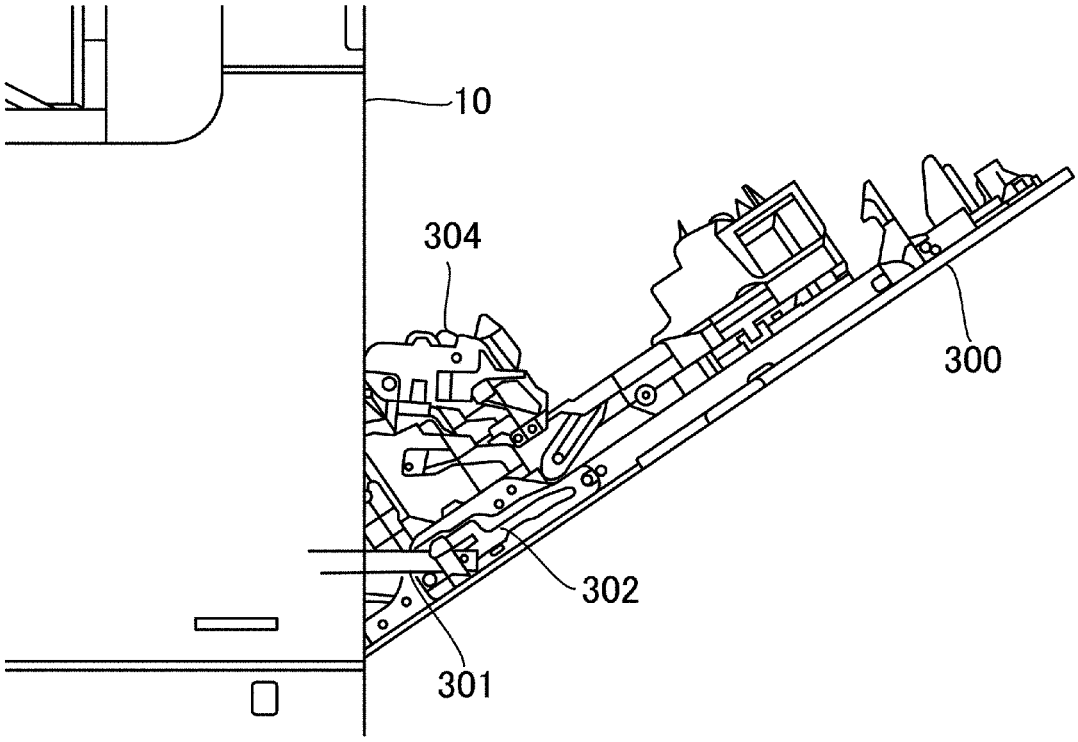

FIG. 9 is a schematic view showing the case where the door is in a third open position.

Figure 10:
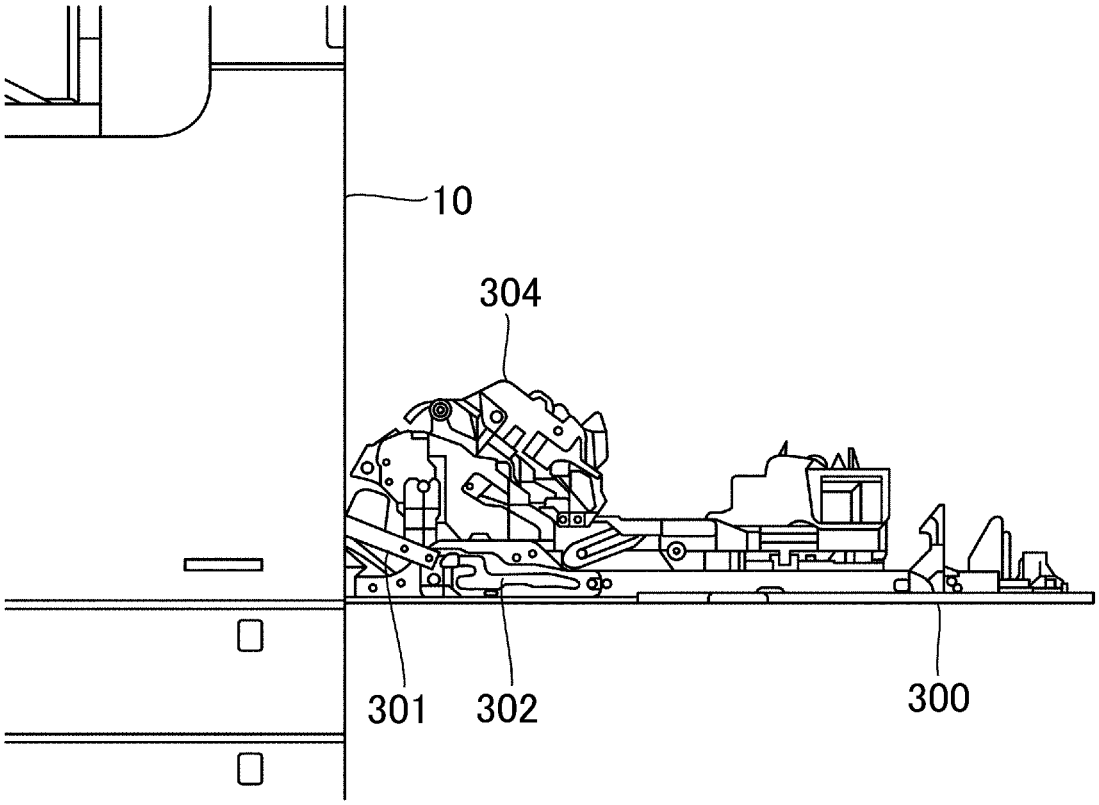

FIG. 10 is a schematic view showing the case where the door is in a fourth open position.

Figure 11:
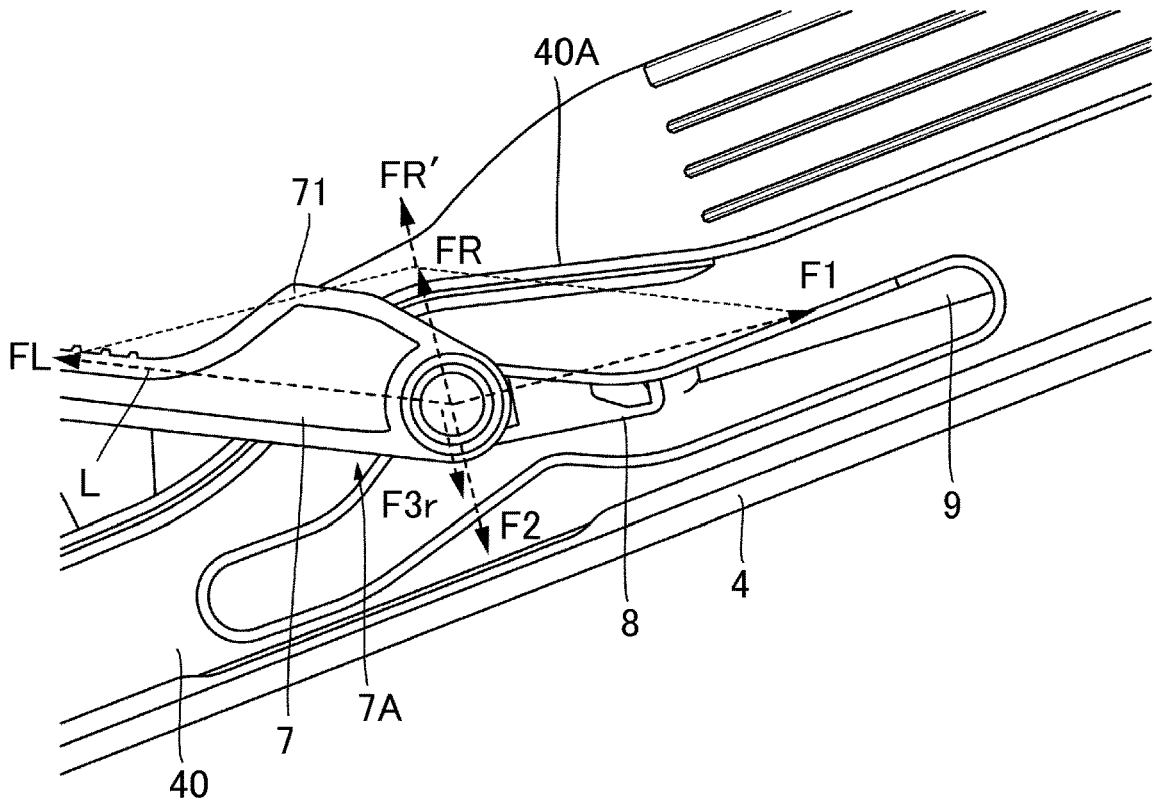
Figure 11:
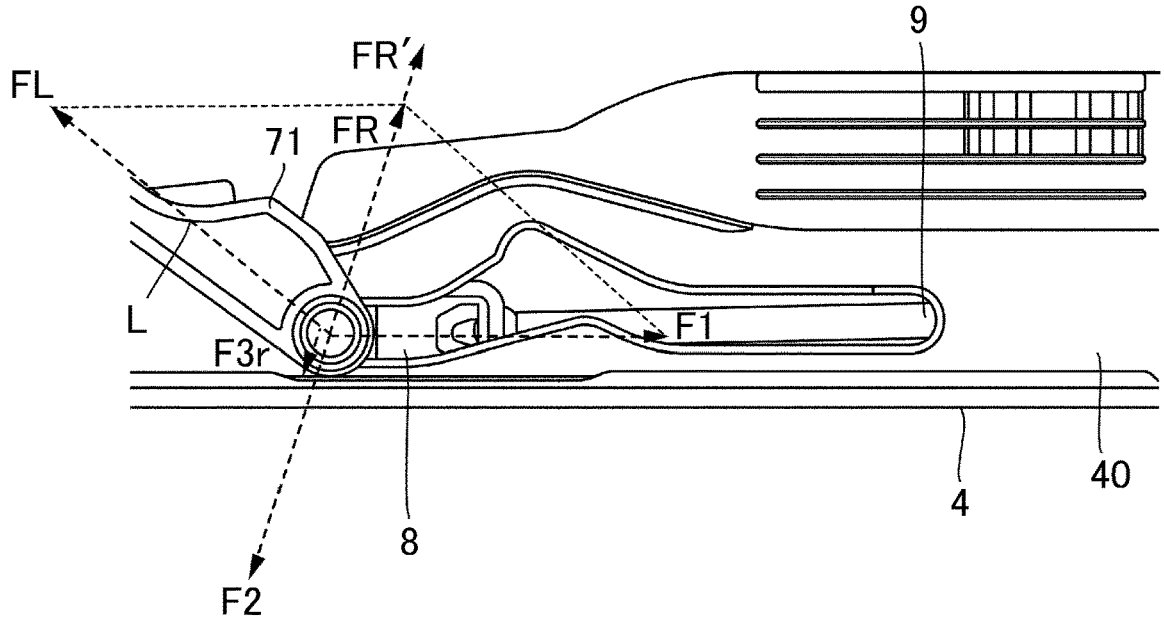

Part (a) of FIG. 11 is a schematic view for illustrating a relationship between forces acting on the manual feeding tray in the first open position, and part (b) of FIG. 11 is a schematic view for illustrating a reach between forces acting on the manual feeding tray in the second open position.

Figure 12:
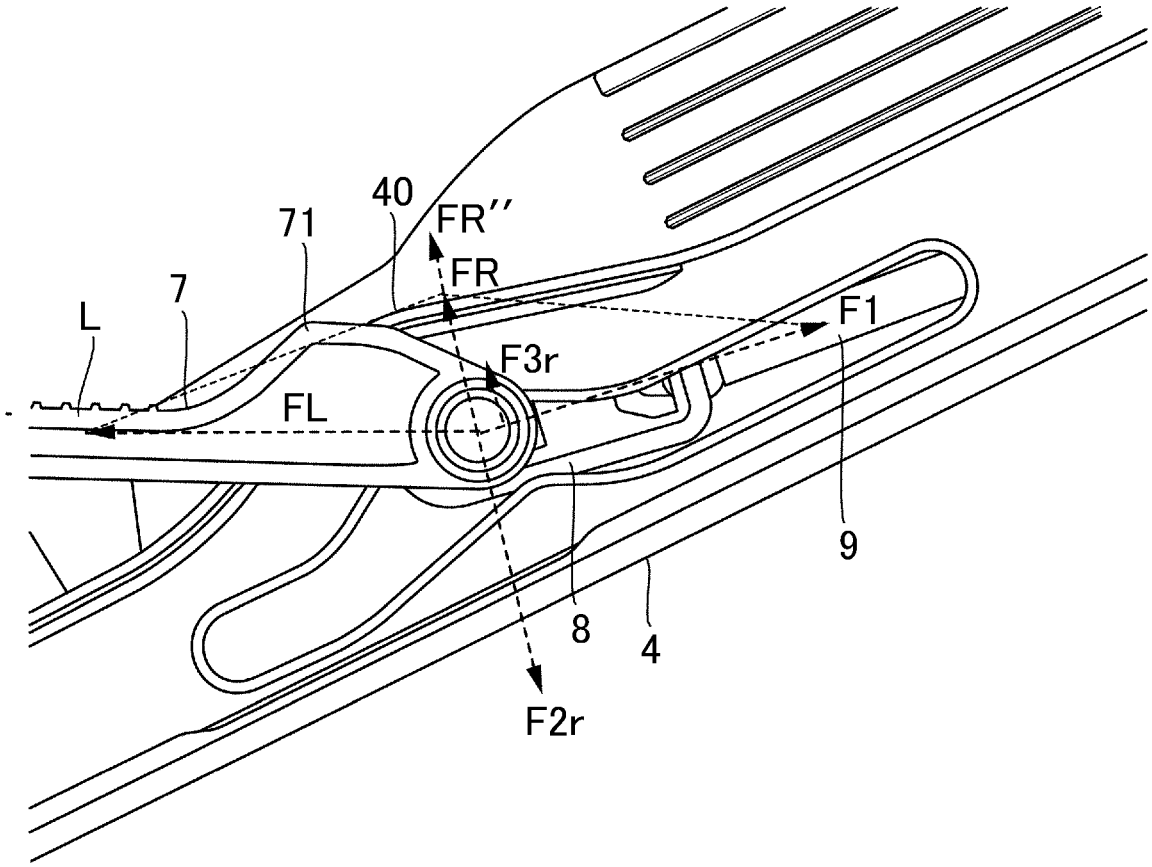

FIG. 12 is a schematic view for illustrating a relationship between forces acting on the manual feeding tray in the case where a link slider slides.

Figure 13:
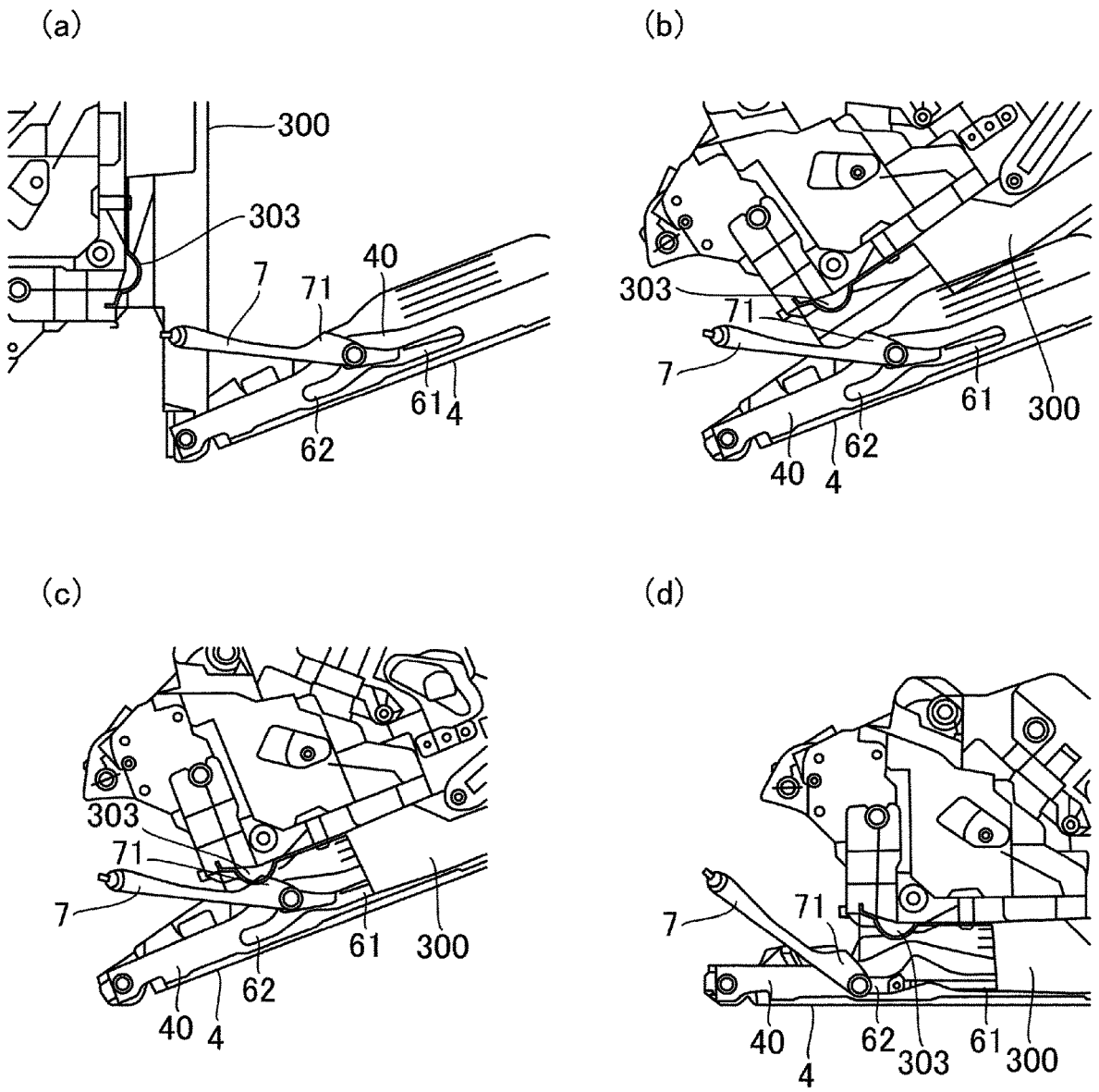

Parts (a) to (d) of FIG. 13 are schematic views for illustrating an operation until the door in a second closed state reaches the fourth open position in the case where the manual feeding tray is in the first open position.

Figure 14:
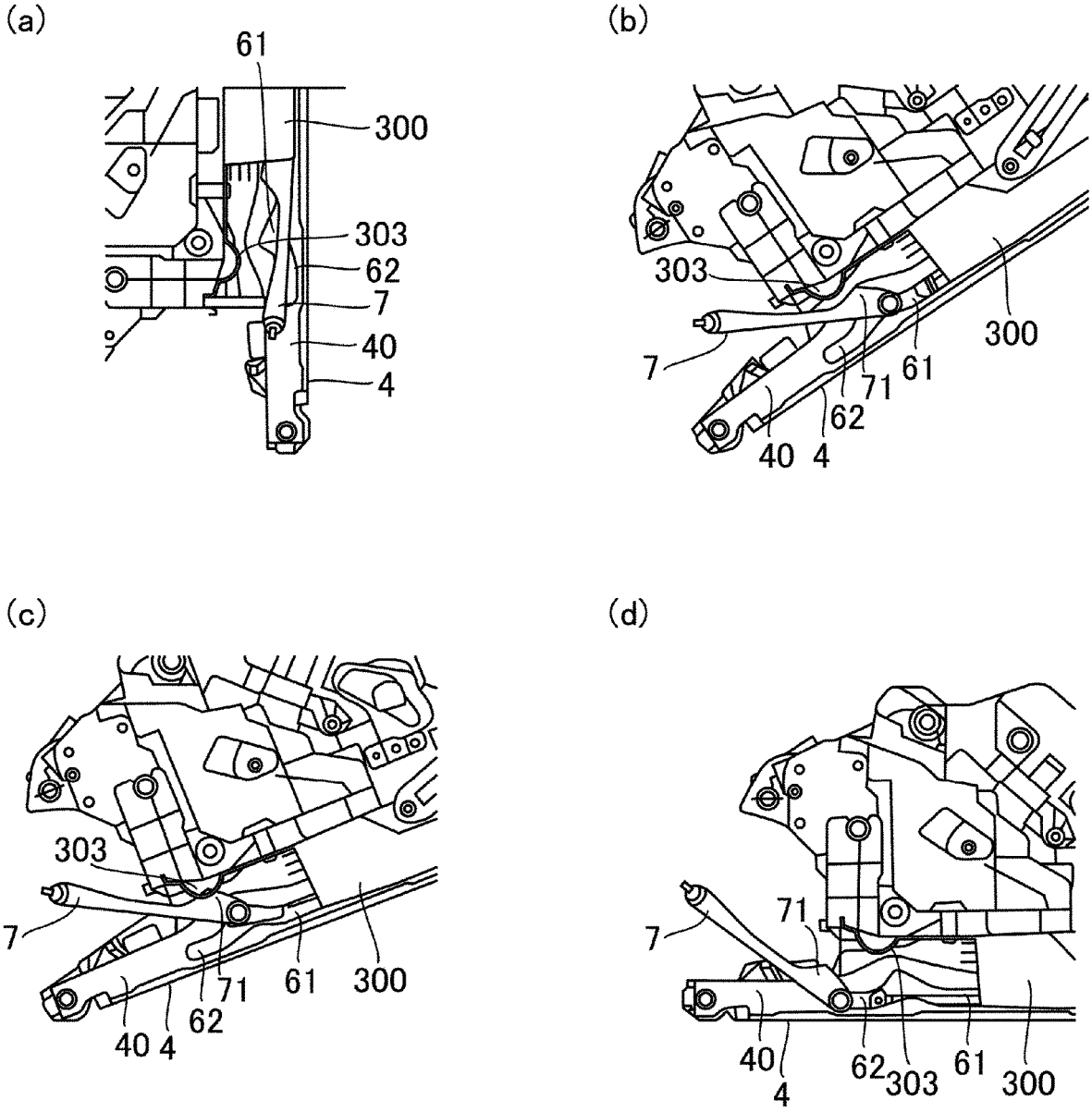

Parts (a) to (d) of FIG. 14 are schematic views for illustrating an operation until the door in the second closed state reaches the fourth open position in the case where the manual feeding tray is in the first closed state.

DESCRIPTION OF THE EMBODIMENTS

Figure 1:
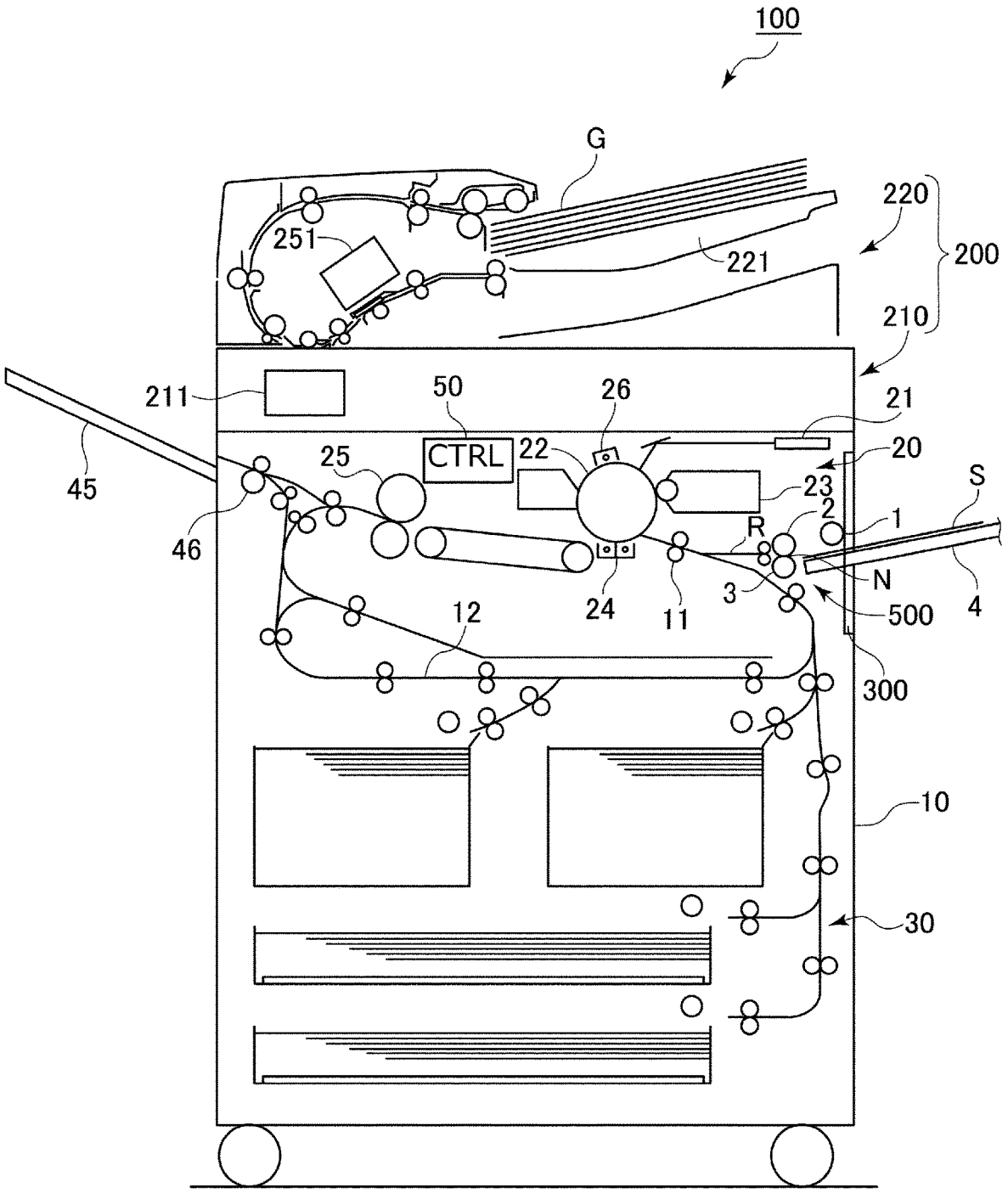
FIG. 1 is a schematic view showing a general structure of an image forming apparatus.

In the following, a sheet feeding device and an image forming apparatus in an embodiment will be described. First, with reference to FIG. 1, a structure of a printer 100 which is the image forming apparatus in this embodiment will be described. As shown in FIG. 1, the printer 100 includes an image reading apparatus 200 for reading an image of an original G stacked on an original stacking tray 221 and includes an apparatus main assembly 10 as a casing including an image forming portion for forming the image, read by the image reading apparatus 200, on a sheet S. The printer 100 includes a controller 50 for controlling the image reading apparatus 200 and the apparatus main assembly 10. The printer 100 shown in FIG. 1 is a laser beam printer of an electrophotographic type, but the sheet feeding device in this embodiment is also applicable to printers using, as an image forming means, an ink jet type and other image forming methods (means).

The image reading apparatus 200 includes a first reading portion 211 and a second reading portion 251 and is provided with a scanner portion 210 for reading the image of the original G, and an automatic document (original) reader (ADF) 220 capable of automatically feeding the original G to the scanner portion 210. Here, the first reading portion 211 is a reading portion used during moving reading or fixed reading of a first surface (front surface) of the original G.

The second reading portion 251 is a reading portion used during the moving reading of a second surface (back surface) of the original G.

The apparatus main assembly 10 includes an image forming means 20 for forming the image on the sheet S, a main assembly sheet feeding means 30 for feeding the sheet S stacked inside of the apparatus main assembly 10 to the image forming means 20, and a manual sheet feeding means 500 as the sheet feeding device. Further, the apparatus main assembly 10 includes a discharging roller pair 46 for discharging the image-formed sheet S to an outside of the apparatus main assembly 10 and a sheet discharge tray 45 on which the sheet S discharged is stacked. Further, the apparatus main assembly 10 is provided with a door 300 for permitting access to an inside of the apparatus main assembly 10 so that a jammed sheet S is removed and a consumable part of an inside of the apparatus main assembly 10 can be exchanged. The door 300 may also have a constitution in which a feeding guide 304 (FIGS. 9 and 10) for forming a feeding passage R along which the sheet S is fed inside the apparatus main assembly 10 is provided.

The image forming means 20 includes a photosensitive drum 22 on which a toner image is formed, a laser scanner unit 21 for irradiating the photosensitive drum 22 with laser light, a transfer portion 24 for transferring the toner image onto the sheet S, and a fixing portion 25 for fixing the toner image on the sheet S. On a side upstream of the transfer portion 24 in a feeding passage along which the sheet S is fed, a registration roller pair 11 is provided.

Next, an image forming operation of the printer 100 will be described. In this embodiment, the case where on the basis of image information of the original G read by the scanner portion 210, an image is formed on the sheet S fed from the manual sheet feeding means 500 will be described as an example. On the basis of the image information of the original G read by the scanner portion 210, the photosensitive drum 22 is irradiated with the laser light from the laser scanner unit 21. At this time, the photosensitive drum 22 is electrically charged in advance through a charging member 26. The charged photosensitive drum 22 is irradiated with the laser light, whereby an electrostatic latent image is formed on the surface of the photosensitive drum 22. The thus-formed electrostatic latent image is developed with a developing device 23 and is formed as a toner image on the photosensitive drum 22.

In parallel to an operation of forming the toner image on the photosensitive drum 22, the sheet S stacked on a manual feeding tray 4 of the manual sheet feeding means 500 is fed by a pack-up roller 1 is nipped in a separation nip N between a feed roller 2 and a retard roller 3 and is separated one by one and then is fed. The sheet S separated one by one is synchronized with the toner image on the photosensitive drum 22 by the registration roller pair 11 and then is sent to a transfer portion 24.

The transfer portion 24 transfers, onto the sheet S, the toner image on the photosensitive drum 22 synchronized with the sheet S separated and fed one by one from the separation nip N. The sheet S on which the toner image is transferred by the transfer portion 24 is heated and pressed by a fixing portion 25. The heated and pressed sheet S transferred on the sheet S is fixed on the sheet by this heating and pressing. The sheet S on which the toner image is fixed is discharged onto the sheet discharge tray 45 by the discharging roller pair 46 and then are successively stacked onto the sheet discharge tray 45. Incidentally, in the case where images are formed on double (both) surfaces (sides) of the sheet S, after the image is formed on a first surface of the sheet S, the sheet S is fed again toward the registration roller pair 11 through a reverse feeding passage 12, and then the above-described operation is repetitively performed.

<Structures of Manual Sheet Feeding Portion and Door>

Next, with reference to FIGS. 2 to 14, structures of the manual sheet feeding means 500 and the door 300 in this embodiment will be described. In the following description, a direction in which the manual feeding tray 4 as a sheet feeding portion opens relative to the apparatus main assembly 10 and a direction in which the manual feeding tray 4 is closed to the apparatus main assembly 10 are referred to as a "tray open direction" and a "tray link close direction", respectively. Further, a direction in which the door 300 as an openable portion opens relative to the apparatus main assembly 10 and a direction in which the door 300 is closed to the apparatus main assembly 10 are referred to as a "door open direction" and a "door close direction", respectively.

Each of parts (a) and (b) of FIG. 2, parts (a) and (b) of FIG. 3 and parts (a) and (b) of FIG. 5 is a schematic view showing a structure of the manual sheet feeding means 500 including the manual feeding tray 4 in a different open/close state. Here, a position of the manual feeding tray 4 shown in parts (a) and (b) of FIG. 2 with respect to the toner open/close direction is a position where the manual feeding tray 4 opens with a predetermined angle in the direction in which the manual feeding tray 4 opens relative to the apparatus main assembly 10 in the case where a feeding operation of the sheet S is performed (hereinafter, this position is referred to as a "feeding position"). In this embodiment, an angle of the manual feeding tray 4 relative to the apparatus main assembly 10 in the feeding position is referred to as a first angle. A position of the manual feeding tray 4 shown in parts (a) and (b) of FIG. 3 with respect to the tray open/close direction is a position where the manual feeding tray 4 is further opened from the feeding position in the tray open direction in the case where maintenance such that component parts including various rollers such as the pick-up roller are exchanged is performed or in the like case (hereinafter, this position is referred to as a "maintenance position"). That is, an angle of the manual feeding tray 4 in the maintenance position relative to the apparatus main assembly 10 is larger than the first angle. In this embodiment, the angle of the manual feeding tray 4 in the maintenance position relative to the apparatus main assembly 10 is referred to as a second angle. A position of the manual feeding tray 4 shown in parts (a) and (b) of FIG. 4 in the tray open/close direction is a state in which the manual feeding tray 4 is closed to the apparatus main assembly 10 such as the case where the sheet feeding operation is not performed or the like case, i.e., a position where the manual feeding tray 4 is accommodated in the apparatus main assembly 10 (hereinafter, this position is referred to as an "accommodating position").

The manual sheet feeding means 500 includes the manual feeding tray 4, the pick-up roller 1, the feed roller 2, the retard roller 3, and as a link portion, a tray link 7 and a link slider 8. As shown in part (b) of FIG. 2, the pick-up roller 1 is constituted so as to capable of feeding the sheet S supported by the manual feeding tray 4 being in the feeding position. The feed roller 2 and the retard roller 3 are constituted so as to be capable of separating the sheet S one by one fed by the pick-up roller 1 and also functions as a sheet separating portion.

The manual feeding tray 4 is openably supported by the apparatus main assembly 10 and is constituted so as to be capable of supporting the sheet S. The manual feeding tray 4 is provided, as shown in parts (a) and (b) of FIG. 5 and FIG. 6, with a guiding member 40 for guiding the tray link 7 and the link slider 8. The guiding member 40 is provided on each of opposite sides with respect to a widthwise direction of the sheet S parallel to a rotational axis direction (an arrow AX direction of FIG. 2) of the manual feeding tray 4. Further, the guiding member 40 is provided with a guiding passage 60 including a main rail 61 as a first guiding passage and a sub-rail 62, as a second guiding passage, constituted in communication with the main rail 61. The main rail 61 includes a first end portion 61*a* and a first portion 61*c* as shown in FIG. 6. The first end portion 61*a* is one end portion of the main rail 61 where the link slider 8 can reach the first end portion 61*a* in a first closed position where the manual feeding tray 4 is in the accommodating position. Incidentally, in a position of the link slider 8 on the main rail 61 in the first closed position does not necessarily reach the first end portion 61*a* depending on an urging force of a tray link spring 9 described later.

The main rail 61 is provided with a second end portion 61*b* on the other side opposite from the side where the first end portion 61*a* is positioned. The second end portion 61*b* is a first locking portion in this embodiment, and at the second end portion 61*b*, the link slider 8 is put in a locked state where the link slider 8 is locked, so that the manual feeding tray 4 is kept in a state in which the manual feeding tray 4 is in the feeding position, i.e., is kept in a first open position. The first portion 61*c* is a portion where the tray link 7 and the link slider 8 slide when the manual feeding tray 4 moves from the first closed position toward the first open position. The sub-rail 62 includes an end portion 62*a* as a second locking portion where the link slider 8 is locked in a second open position where the manual feeding tray 4 is in the maintenance position.

In the sub-rail 62, at a communicating portion PC with the main rail 61, an allowable region AR broader than a width of the end portion 62*a* is provided. By such a shape of the communicating portion PC, in the case where the locked state of the link slider 8 at the end portion 62*a* is released, the tray link 7 and the link slider 8 are allowed to enter the allowable region AR. Then, from the main rail 61, the tray link 7 and the link slider 8 are guided, and the link slider 8 is locked by the end portion 62*a*, so that the manual feeding tray 4 is kept in a second open position. Further, the manual feeding tray 4 is provided, as shown in part (a) of FIG. 2, with a projected tray engaging portion 5 constituted so as to be engageable with an unshown recessed portion of the apparatus main assembly 10. The manual feeding tray 4 being in the accommodating position is held in a tray accommodating position by engagement of the tray engaging portion 5 with the recessed portion of the apparatus main assembly 10, i.e., in the first closed position.

Incidentally, in this embodiment, a shape of the sub-rail 62 (second guiding passage) is such that the sub-rail 62 branches from the main rail 61 (first guiding passage) at a branding position P. In the case where the sub-rail 62 branches from the main rail 61. A width of the branching portion P is made broader (wider) than a width of the end portion 62*a*. When such a shape is formed, in the case where the locked state of the link slider 8 at the end portion 62*a* is released, the tray link 7 and the link slider 8 are allowed to enter the branching portion P, so that the tray link 7 and the link slider 8 are guided from the main rail 61 to the sub-rail 62. Then, the link slider 8 is locked by the end portion 62*a*, so that the manual feeding tray 4 is kept in the second open position. However, the shape of the sub-rail 62 may also be a shape such that the sub-rail 62 does not clearly branch from the main rail 61. As the shape such that the sub-rail 62 does not clearly branch from the main rail 61, for example, in the case where the locked state of the link slider 8 at the end portion 62*a* is released, a constitution in which the tray link 7 and the link slider 8 are guided from the main rail 61 to the sub-rail 62 may only be required to be employed.

The manual feeding tray 4 is constituted so as to be movable between the first closed position corresponding to the tray accommodating position, the first open position corresponding to the tray feeding position and the second open position corresponding to the tray maintenance position. The tray link 7 is rotatably supported by the apparatus main assembly 10. Further, the tray link 7 includes, as shown in part (b) of FIG. 3, the link slider 8 as an engaging portion slidably engaging with the manual feeding tray 4. The link slider 8 is connected to the tray link through an unshown boss and is constituted so as to be slidable on the main rail 61 and the sub-rail 62 which are provided in the manual feeding tray 4. That is, the link slider 8 is constituted so as to be slidable between the first end portion 61*a*, the second end portion 61*b* and the end portion 62*a* while drawing a movement locus A and a movement locus B (FIG. 6).

Further, between the link slider 8 and the manual feeding tray 4, the tray link spring 9 as an urging member is provided. The tray link spring 9 is engaged and supported by an engaging supporting element (not shown) such as a hook-shaped portion which is engaged with the link slider 8 at one end thereof and which is provided on the manual feeding tray 4 at the other end thereof. By the tray link spring 9 engaged supported by the manual feeding tray 4, the tray link 7 and the link slider 8 are urged in a tray closing direction. Here, as seen in the rotational axis direction of the tray link 7 and the link slider 8, a rectilinear line connecting a rotation center D of the tray link 7 and a center C of the link slider 8 at a connecting portion to the tray link 7 is referred to as an axis L of the tray link 7 (part (b) of FIG. 4). Further, an angle formed by the axis L of the tray link 7 and an urging force F1 of the tray link spring 9 acting on the link slider 8 on the apparatus main assembly 10 side is referred to as θ. In this case, as shown in FIG. 7, in order to urge tray link 7 and the link slider 8 in the tray closing direction, at the first open position, the angle θ has to be an obtuse angle, i.e., has to be larger than 90° and smaller than 180°. Accordingly, by setting arrangement of the tray link 7 and an urging direction of the urging force F1 so that the angle θ satisfies: $90° < \theta < 180°$ in the first position, the tray link 7 and the link slider 8 are urged in the tray closing direction.

FIGS. 8 to 10 are schematic views showing structures of the door 300 put in open/close states different from each other. Here, a position of the door 300 shown in FIG. 8 with respect to a door open/close direction is a position where the door 300 is closed and accommodated in the apparatus main assembly 10 as in the case where the image forming operation of the printer is performed or in the like case (hereinafter, this position is referred to as a "door accommodating position"). A position of the door 300 shown in FIG. 9 with respect to the door open/close direction is a position where the door 300 opens relative to the apparatus main assembly 10 in the case where removal of a jammed sheet (the sheet stagnating in the feeding passage) is carried out (hereinafter, this position is referred to as a "jam clearance position"). A position of the door 300 shown in FIG. 10 with respect to the door open/close direction is a position where the door 300 is further opened from the jam clearance position in the door open direction in the case where maintenance such that a component part provided inside the apparatus main assembly 10 is exchanged is performed (hereinafter, this position is referred to as a "door maintenance position").

As shown in FIGS. 9 and 10, the door 300 includes a door link guide 302 for guiding a door link 301 rotatably supported by the apparatus main assembly 10, and the door link guide 302 is provided rotatably relative to the apparatus main assembly 10. The door link guide 302 has a shape such that the door link guide 302 guides the door link 301 so that the position of the door 300 is movable between the door accommodating position, the jam clearance position and the door maintenance position. That is, the door 300 is constituted so as to be movable between the door accommodating position, the jam clearance position and the door maintenance position by changing a position where the door link 301 is guided manually by a user through the door link guide 302. Incidentally, in this embodiment, as the position of the door 300, the position when the door 300 is in the door accommodating position is referred to as a second closed position, the position when the door 300 is in the jam clearance position is referred to as a third open position, and the position when the door 300 is in the door maintenance position is referred to as a fourth open position. Here, in order to realize coexistence of the door 300 and the manual feeding tray 4, each of the angles of the door 300 and the manual feeding tray 4 relative to the apparatus main assembly 10 is set so that a relationship of: (angle at third open position)<(angle at first open position)<(angle at fourth open position)≤(angle at second open position) is satisfied.

Next, actions of the thus-constituted manual sheet feeding means 500 and the door 300 will be described. The manual feeding tray 4 of manual sheet feeding means 500 is capable of switching an angle thereof relative to a side surface of the apparatus main assembly 10 to three pre-set angles. That is, the manual sheet feeding means 500 is capable of positioning the manual feeding tray 4 by switching the position of the manual feeding tray 4 to each of the positions (angles) consisting of the accommodating position, the feeding position and the maintenance position. These positions of the manual feeding tray 4 are switched depending on a position where the link slider 8 is located in the guiding passage 60. At the accommodating position, the link slider 8 is positioned at the first end portion 61*a* of the main rail 61 or in the neighborhood of the first end portion 61*a*. At the feeding position, the link slider 8 is positioned in a state in which the link slider 8 is locked by the second end portion 61*b*. At the maintenance position, the link slider 8 is positioned in a state in which the link slider 8 is locked by the end portion 62*a*.

When the manual feeding tray 4 moves from the first closed position where the manual feeding tray 4 is in the accommodating position to the first open position where the manual feeding tray 4 is in the feeding position, the user performs an operation in which the user opens the manual feeding tray 4 relative to the apparatus main assembly 10 without applying a force resisting the urging force F1 (hereinafter, this operation is referred to as a "normal opening operation". By performing the normal opening operation, the link slider 8 slides from the first end portion 61*a* to the second end portion 61*b* and is positioned at the second end portion 61*b*. Incidentally, in the manual feeding tray 4, the main rail 61 is provided on the tray closing direction side than the sub-rail 62 is. Further, by the tray link spring 9, the tray link 7 and the link slider 8 are urged in the tray closing direction. Accordingly, in the case where the normal opening operation is performed when the manual feeding tray 4 moves from the first closed position to the first open position, the tray link 7 and the link slider 8 are not guided from the main rail 61 to the sub-rail 62. Further, in the case where the normal opening operation is performed when the manual feeding tray 4 moves from the first closed position to the first open position, the link slider 8 slides on the main rail 61 and is locked by the second end portion 61*b*.

Further, positioning of the link slider 8 is carried out by setting, as the urging force F1, a restoring force of the tray link spring so that of forces acting on the manual feeding tray 4, a force in the tray closing direction and a force in the tray opening direction are balanced with each other. For example, in the case where the position of the manual feeding tray 4 is kept in the feeding position, the urging force F1 is set as shown in part (a) of FIG. 11. In part (a) of FIG. 11, the force in the tray closing direction is generated by a resultant force FR between the urging force F1 acting on the manual feeding tray 4 through the link slider 8 and the tray link 7 and a tensile force FL for pulling the tray link 7 by the apparatus main assembly. On the other hand, the force in the tray opening direction is generated by a force F2 acting on the manual feeding tray 4.

The resultant force FR acts on the manual feeding tray 4 at a connecting point between the tray link 7 and the link slider 8. Further, the force F2 shown in part (a) of FIG. 11 is a force resulting from gravity acting on the manual feeding tray 4 at the connecting point between the tray link 7 and the link slider 8. As regards a relationship between the resultant force FR and the force F2, in the case where the manual feeding tray 4 is kept in the feeding position, the urging force F1 is set so that the resultant force FR and the force F2 are balanced with each other.

By such setting of the urging force F1, a direction of moment caused to act on the manual feeding tray 4 by the tray link 7 and the link slider 8 is opposite to a direction of moment generated by a self-weight of the manual feeding tray 4 being in the feeding position. Further, a magnitude of the resultant force FR balances with the moment generated by the self-weight of the manual feeding tray 4 being in the feeding position. Therefore, the forces acting on the manual feeding tray 4 in the tray closing direction and the tray opening direction are balanced with each other, and therefore, the position of the manual feeding tray 4 is kept in the feeding position. In this embodiment, in the case where the position of the manual feeding tray 4 is kept in the feeding position, the link slider 7 slides on the main rail 61 to the end portion of the main rail 61 with respect to the tray opening direction, i.e., the second end portion 61*b*. Then, the link slider 8 reached the second end portion 61*b* is put in a locked state in which the link slider 8 is locked by the second end portion 61*b*, so that the link slider 8 is positioned to the second end portion 61*b*.

Incidentally, strictly, when a component force, with respect to a rotational direction of the tray link 7, of a frictional force generated on a sliding surface between the link slider 8 and the manual feeding tray 4 at the second end portion 61*b* is defined as a component force F3*r*, the component force F3 and the force F2 are exerted in the same direction. Therefore, in this embodiment, the urging force F1 may also be set in consideration of the influence of the component force F3*r*. In the case where the influence of the component force F3 is taken into consideration, a resultant force between the urging force F1 acting on the manual feeding tray 4 through the link slider 8 and the tray link 7 and the tensile force FL for pulling the tray link 7 by the apparatus main assembly 10 is defined as a resultant force FR'. In this case, the urging force F1 is set so that the resultant force FR' is balanced with a resultant force (F2+F3*r*) between the force F2 and the component force F3*r* after the link slider 8 reaches the second end portion 61*b*. By setting the urging force F1 in this manner, the manual feeding tray 4 is kept in the feeding position (first open position). Incidentally, in the case where the link slider 8 is in a locked state in which the link slider 8 is locked by the second end portion 61*b*, when sheets are stacked on the manual feeding tray 4, the tensile force FL for pulling the tray link 7 by the apparatus main assembly 10 is increased by a weight of the sheets. Further, the force F2 acting on the manual feeding tray 4 also becomes a force which is the sum of the self-weight of the manual feeding tray 4 and the weight of the sheets. In this case, by the increase of the force FL, the resultant force FR also becomes large, and therefore, even when the force F2 of the manual feeding tray 4 is increased by the sheets, the position of the manual feeding tray 4 is kept in the feeding position.

Further, when the manual feeding tray 4 moves from the tray accommodating position to the feeding position, i.e., in a section in which the link slider 8 slides on the main rail 61, the urging force F1 is set as shown in FIG. 12. That is, the urging force F1 is set so that a resultant force FR" (FR+F3*r*) between the resultant force FR and the component force F3*r* of the frictional force in the rotational direction. In this case, when the user performs the normal opening operation, even when the user releases his (her) hand before the manual feeding tray 4 reaches the feeding position, the manual feeding tray 4 can be made to open to the feeding position.

On the other hand, when the manual feeding tray 4 moves from the first open position to the first closed position, the user performs an operation of closing the manual feeding tray 4 to the apparatus main assembly 10. By the closing operation of the manual feeding tray 4, the link slider 8 slides from the second end portion 61*b* toward the first end portion 61*a* and then is positioned at the first end portion 61*a* (or in the neighborhood of the first end portion 61*a*). At the tray accommodating position, the tray engaging portion 5 shown in part (a) of FIG. 2 and a recessed portion (not shown) engage with each other, so that the manual feeding tray 4 is kept in the first closed position. Incidentally, in this embodiment, from the viewpoint of prevention of interference with the manual feeding tray 4, the link slider 8 and the guiding passage 60 are designed so that the link slider 8 falls within a region of the guiding passage 60 when the manual feeding tray 4 is accommodated in the apparatus main assembly 10.

Then, in the case where the manual feeding tray 4 is moved from the feeding position or the accommodating position to the maintenance position, i.e., the case where the manual feeding tray 4 is moved from the first open position or the first closed position to the second open position will be described. As a first method, the tray link 7 and the link slider 8 are guided by applying a force resisting the urging force F1. The first method is manually carried out by the user. Further, as a second method, the tray link 7 is pressed downward against the manual feeding tray 4 during sliding of the link slider 8 on the main rail 61 or when the link slider 8 is locked by the second end portion 61*b*. In this manner, the tray link 7 and the link slider 8 can be guided to the sub-rail 62. The second method is realized by a manual operation of the user or by urging of the tray link 7 by the contact portion 303. In either method, the tray link 7 and the link slider 8 are guided from the main rail 61 to the sub-rail 62. Then, the link slider 8 slides on the sub-rail 62 and is positioned in a state in which the link slider 8 is locked by the end portion 62*a* of the sub-rail 62.

In this embodiment, the door 300 is provided with the contact portion 303. In the case where the manual feeding tray is in the first open position, the contact portion 303 is provided so that the contact portion 303 is contactable to the tray link 7 from above the manual feeding tray 4. Here, it is assumed that the door 300 is moved to the maintenance position in the case where the manual feeding tray 4 is in the feeding position or the tray accommodating position, i.e., in the first open position or the first closed position.

Parts (a) to (d) of FIG. 13 are schematic views each showing a relative position between the manual feeding tray 4 and the door 300 when the door 300 is moved to the maintenance position in the case where the manual feeding tray 4 is in the first open position. Part (a) of FIG. 13 shows a state in which the door 300 is in the second closed position, and part (b) of FIG. 13 shows a state in which the door 300 is in the jam clearance position. Part (c) of FIG. 13 shows a state in which the door 300 is in the feeding position of the manual feeding tray 4, i.e., in a state in which the door 300 reaches the first open position of the manual feeding tray 4. Part (d) of FIG. 13 shows a state in which the manual feeding tray 4 and the door 300 are in the tray maintenance position and the door maintenance position, respectively, i.e., in the second open position and the fourth open position, respectively.

Further, parts (a) to (d) of FIG. 14 are schematic views each showing a relative position between the manual feeding tray 4 and the door 300 when the door 300 is moved to the maintenance position in the case where the manual feeding tray 4 is in the first closed position. Part (a) of FIG. 14 shows a state in which the manual feeding tray 4 and the door 300 are in the first closed position and the second closed position, respectively, and part (b) of FIG. 14 shows a state in which the door 300 and the manual feeding tray 4 are in the jam clearance position. Part (c) of FIG. 14 shows a state in which the door 300 and the manual feeding tray 4 are in the feeding position of the manual feeding tray 4, i.e., in a state in which the door 300 reaches the first open position of the manual feeding tray 4. Part (d) of FIG. 14 shows a state in which the manual feeding tray 4 and the door 300 are in the tray maintenance position and the door maintenance position, respectively, i.e., in the second open position and the fourth open position, respectively.

As shown in parts (a) to (d) of FIG. 13 and parts (a) to (d) of FIG. 14, the contact portion 303 contacts the tray link 7 from above the manual feeding tray 4 on the way that the door 300 reaches the door maintenance position from the jam clearance position. At this time, the contact portion 303 contacts the tray link 7 when the door 300 opens to a position exceeding the first open position of the manual feeding tray 4. Then, the contact portion 303 presses the tray link 7, so that the locked state of the link slider 8 by the second end portion 61*b* is released and thus the tray link 7 and the link slider 8 are guided from the main rail 61 to the sub-rail 62. As described above, the link slider 8 is guided from the main rail 61 to the sub-rail 62, whereby the link slider 8 slides on the sub-rail 62 and then is positioned to the end portion 62*a*.

Accordingly, in this embodiment, in the case where the manual feeding tray 4 is in the first open position or the tray closed position, when the door 300 is moved to the door maintenance position, at the same time when the manual feeding tray 4 is moved to the tray maintenance position, the door 300 is moved to the door maintenance position. That is, even when the manual feeding tray 4 is not moved to the tray maintenance position, the door 300 can be moved to the door maintenance position. Further, in the case where the manual feeding tray 4 is in the tray maintenance position, i.e., in the second open position, an angle of the fourth open position is smaller than an angle of the second open position and therefore, the door 300 moving toward the door maintenance position and the manual feeding tray 4 do not interfere with each other.

Further, in this embodiment, the tray link 7 is provided with a projection 71. The projection 71 is provided so as to project upward from an upper surface 40A of the guiding member 40 provided with the guiding passage 60 in the manual feeding tray 4 in the case where the manual feeding tray 4 is in the first open position (part (a) of FIG. 11). Further, in the tray link 7, the projection 71 is provided at an engaging-side end portion 7A with the link slider 8 (part (a) of FIG. 11, part (a) of FIG. 4). By such a shape and arrangement, in the case where the manual feeding tray 4 is in the first open position, the projection 71 contacts the contact portion 303 before the angle of the door 300 exceeds the angle of the jam clearance position and reaches the angle of the feeding position of the manual feeding tray 4, i.e., at a position in front of the manual feeding tray 4. For that reason, when the door 300 is moved to the door maintenance position, by the contact portion 303, the tray link 7 is pressed downward toward the manual feeding tray 4, so that the manual feeding tray 4 can be moved to the tray maintenance position with reliability. Further, as shown in parts (a) and (b) of FIG. 13 and parts (a) and (b) of FIG. 14, when the door 300 is moved between the door accommodating position and the jam clearance position, the contact portion 303 and the tray link 7 do not contact each other. Accordingly, when the door 300 moves between the door accommodating position and the jam clearance position, the manual feeding tray 4 is not moved to the tray maintenance position and is held in the feeding position or the tray accommodating position.

By such a constitution, when the door 300 is moved to the door maintenance position, i.e., the fourth open position, in this embodiment, the user is not required to move the manual feeding tray 4 to the tray maintenance position, i.e., the second open position in advance. Accordingly, even when the door 300 is intended to be moved to the door maintenance position without performing an operation of moving the manual feeding tray 4 to the tray maintenance position, the door 300 and the manual feeding tray 4 do not interfere with each other.

Incidentally, positioning of the link slider 8 in the case where the manual feeding tray 4 is in the maintenance position is similar to the positioning of the link slider in the case where the manual feeding tray 4 is in the feeding position. That is, in the case where the position of the manual feeding tray 4 is kept in the maintenance position, the urging force F1 is set as shown in part (b) of FIG. 11. That is, a restoring force of the tray link spring 9 as the urging force F1 is set so that of forces acting on the manual feeding tray 4, the force in the tray closing direction and the force in the tray opening direction balance with each other. Even in the case where the manual feeding tray 4 is in the maintenance position, the force in the tray closing direction is generated by a resultant force FR between a component force of the urging force F1 acting on the manual feeding tray 4 through the link slider 8 and the tray link 7 and a tensile force FL for pulling the tray link 7 by the apparatus main assembly 10. On the other hand, the force in the tray opening direction is generated by the force F2 acting on the manual feeding tray 4. When description is made using a relationship between the resultant force FR and the force F2, as shown in part (b) of FIG. 11, by setting the urging force F1 so that the resultant force FR and the force F2 balance with each other, the position of the manual feeding tray 4 can be kept in the maintenance position.

By such setting of the urging force F1, a direction of moment caused to act on the manual feeding tray 4 by the tray link 7 and the link slider 8 is opposite to a direction of moment generated by a self-weight of the manual feeding tray 4 being in the maintenance position. Further, a magnitude of the resultant force FR balances with the moment generated by the self-weight of the manual feeding tray 4 being in the maintenance position. Therefore, the forces acting on the manual feeding tray 4 in the tray closing direction and the tray opening direction are balanced with each other, and therefore, the position of the manual feeding tray 4 is kept in the maintenance position. In this embodiment, in the case where the position of the manual feeding tray 4 is kept in the maintenance position, the link slider 7 slides on the main rail 61 to the end portion of the sub-rail 62 with respect to the tray opening direction, i.e., to the end portion 62*a*. Then, the link slider 8 having reached the end portion 62*a* is put in a locked state in which the link slider 8 is locked by the end portion 62*a* of the sub-rail 62, so that the link slider 8 is positioned to the end portion 62*a*.

When the manual feeding tray 4 is moved from the second open position to the first closed position, similarly as when the manual feeding tray 4 is moved from the first open position to the first closed position, the manual feeding tray 4 may only be required to be closed to the apparatus main assembly 10. By this closing operation, the link slider 8 starts to slide from the end portion 62*a* in a direction opposite to the arrow direction of the movement locus B (FIG. 6), i.e., starts to slide toward the first end portion 61*a* side of the main rail 61. Thereafter, the link slider 8 is guided from the sub-rail 62 to the main rail 61 and slides on the first portion 61*c* and then is positioned in the first end portion 61*a* or in the neighborhood of the first end portion 61*a*.

Further, when the manual feeding tray 4 is moved from the second open position to the first open position, the manual feeding tray 4 is once closed to the apparatus main assembly 10 and thus is moved to the first closed position, and therefore, the normal opening operation is carried out. That is, in the case where the manual feeding tray 4 is moved from the second open position to the first open position, the manual feeding tray 4 moves through the first closed position.

As described above, in the case where the manual feeding tray 4 being in the accommodating position is opened by the normal opening operation, the manual feeding tray 4 is not moved to the second open position but is moved to the first open position with reliability. Accordingly, when the manual feeding tray 4 being in the accommodating position is only opened by the normal opening operation, the manual feeding tray 4 is held in the feeding position with reliability.

By the above-described constitution, the tray link 7 and the link slider 8 are not guided from the main rail 61 to the sub-rail 62 as long as the user intentionally guides the tray link 7 and the link slider 8 toward the sub-rail 62 side or performs an operation of opening the door 300 to the door maintenance position. Accordingly, in the normal opening operation, the link slider 8 moves on the main rail 61 without moving toward the sub-rail 62, so that it is possible to prevent the manual feeding tray 4 from being put in the maintenance position (second open position) during the sheet feeding.

Incidentally, the guiding member 40 is provided on each of opposite sides of the manual feeding tray 4 with respect to the widthwise direction of the sheet S parallel to the rotational axis direction (arrow AX direction of part (a) of FIG. 2). Here, the tray link 7 and the link slider 8 provided on one end side X1 of the manual feeding tray 4 is referred to as a first link portion. In this case, the link slider 8 of the first link portion is a first engaging portion in this embodiment, and the tray link spring urging the first link portion is a first urging member in this embodiment. Further, in the door 300, the contact portion 303 contactable to the tray link 7 of the first link portion is a first contact portion in this embodiment. Further, the tray link 7 and the link slider 8 provided on the other end side X2 of the manual feeding tray 4 is referred to as a second link portion opposite from the first link portion. In this case, the link slider 8 of the second link portion is a second engaging portion in this embodiment, and the tray link spring urging the second link portion is a second urging member in this embodiment. Further, in the door 300, the contact portion 303 contactable to the tray link 7 of the second link portion is a second contact portion in this embodiment. Further, on the other end side X2 of the manual feeding tray 4, the main rail 61 and the sub-rail 62 for the second link portion are provided. In this case, the main rail 61 and the sub-rail 62 which are provided on the other end side X2 of the manual feeding tray 4 are a third guiding passage and a fourth guiding passage, respectively, in this embodiment.

Further, according to this embodiment, when a maintenance operation is performed, the manual feeding tray 4 can be put in the maintenance position without being removed (demounted) from the apparatus main assembly 10. Accordingly, a wide operation space can be ensured above the manual feeding tray 4 without removing the manual feeding tray 4 from the apparatus main assembly 10 with a tool. As a result of this, it is possible to ensure a good maintenance property such that the user has access to component parts such as the pick-up roller 1, the feed roller 2 and the retard roller 3, from the manual feeding tray 4 side.

In this embodiment, as described above, the angles of the door 300 and the manual feeding tray 4 relative to the apparatus main assembly 10 are set so as to satisfy the relationship of: (angle of third open position) M<(angle of first open position)<(angle of fourth open position)≤(angle of second open position). In FIGS. 13 and 14, the apparatus main assembly 10 in which the manual feeding tray 4 and the door 300 have a common (same) rotation shaft is shown, but the apparatus main assembly 10 may also be constituted so that the manual feeding tray 4 and the door 300 have rotation shafts different from each other. In this case, in the apparatus main assembly 10, the rotation shaft of the manual feeding tray 4 and the rotation shaft of the door 300 are disposed in parallel to each other (for example, with respect to a direction parallel to the arrow AX direction). Further, the rotation shaft of the manual feeding tray 4 and the rotation shaft of the door 300 are disposed so as to satisfy the relationship of: (angle of third open position)<(angle of first open position)<(angle of fourth open position)≤(angle of second open position). For example, in FIG. 1, in the case where a direction in which the image reading apparatus 200 is provided is referred to as "above" the apparatus main assembly 10, the rotation shaft of the manual feeding tray 4 and the rotation shaft of the door 300 are disposed in the following manner. That is, the rotation shaft of the door 300 is disposed above the rotation shaft of the manual feeding tray 4 so that the rotation shaft of the manual feeding tray 4 and the rotation shaft of the door 300 satisfies the relationship of: (angle of third open position)<(angle of first open position)<(angle of fourth open position)≤(angle of second open position) and so that the rotation shaft of the manual feeding tray 4 and the rotation shaft of the door 300 are parallel to the arrow AX. By this, irrespective of whether or not the manual feeding tray 4 and the door 300 have the common (same) rotation shaft, even when the manual feeding tray 4 is not completely opened to the maintenance position, the door 300 can be opened to the maintenance position without interfering with the manual feeding tray 4.

In this embodiment, in the feeding position, the moment caused to act on the manual feeding tray 4 by the tray link spring 9 is set so that a direction thereof is opposite to the moment generated by gravity exerted on the manual feeding tray 4 being in the feeding position and so that a magnitude thereof is smaller than the magnitude of the moment generated by gravity exerted on the manual feeding tray 4 being in the feeding position. Accordingly, even in the case where the user releases his (her) hand from the manual feeding tray 4, the manual feeding tray 4 can be held in the feeding position. Further, on the manual feeding tray 4 being in the feeding position, the force exerted in the tray closing direction acts, and therefore, when the manual feeding tray 4 is closed from the feeding position to the apparatus main assembly 10, the closing operation of the manual feeding tray 4 can be assisted.

In this embodiment, in the maintenance position, the moment caused to act on the manual feeding tray 4 by the tray link spring 9 is set so that a direction thereof is opposite to the moment generated by gravity exerted on the manual feeding tray 4 being in the feeding position and so that a magnitude thereof is smaller than the magnitude of the moment generated by gravity exerted on the manual feeding tray 4 being in the feeding position. Accordingly, even in the case where the user releases his (her) hand from the manual feeding tray 4, the manual feeding tray 4 being in the maintenance position is not closed to the apparatus main assembly 10 and therefore, the manual feeding tray 4 can be held in the maintenance position. Further, on the manual feeding tray 4 being in the maintenance position, the force exerted in the tray closing direction acts, and therefore, when the manual feeding tray 4 is closed from the maintenance position to the apparatus main assembly 10, the closing operation of the manual feeding tray 4 can be assisted.

In this embodiment, the tray link spring 9 provided between the link slider 8 and the manual feeding tray 4, the tray link 7 and the link slider 8 are urged in the tray closing direction. Accordingly, when the manual feeding tray 4 is opened relative to the apparatus main assembly 10, a damper effect can be obtained, so that it is possible to prevent an occurrence of impact noise and breakage of constituent elements, relating to support of the manual feeding tray 4, such as the tray link 7 and the link slider 8. Therefore, according to this embodiment, it is possible to prevent an occurrence of improper sheet feeding without impairing the maintenance property.

Incidentally, this embodiment is not limited to the above-described form as it is, but can also be carried out in various forms other than the above-described form and can be variously omitted, replaced and changed in a range without departing from the gist thereof.

For example, the manual sheet feeding means 500 may also be constituted by using a tensile spring, a compression spring and a coil spring as the tray link spring 9. Specifically, in the case of using the compression spring, the compression spring is disposed at a position symmetrical to the position of the tray link spring 9 with respect to the connecting portion, as a center, between the tray link 7 and the link slider 8. Further, when the compression spring 9 is disposed, an urging force and an urging direction of the compression spring are set so as to satisfy the urging force F1 and the setting of the angle θ, respectively, in the case of the tray link spring 9 which is the tensile spring. By constituting the manual sheet feeding means 500 with use of such a compression spring, it is possible to expect an effect similar to the effect of the case of the tray link spring 9 which is the tensile spring.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-148621 filed on Aug. 13, 2019, which is hereby incorporated by reference herein in its entirety.

What is claimed is:

1. A sheet feeding device comprising:

a casing;

a door rotatable relative to said casing;

a tray configured to stack a sheet thereon and rotatable between (a) a first closed position where said tray is closed to said casing, (b) a first open position where said tray opens relative to said casing at a first angle, and (c) a second open position where said tray opens relative to said casing at a second angle larger than the first angle; and a sheet feeder provided in said casing and configured to feed the sheet stacked on said tray being in the first open position, wherein said door is rotatable between (a) a second closed position where said door is closed to said casing, (b) a third open position where said door opens relative to said casing at an angle not exceeding the angle of said tray in the first open position, and (c) a fourth open position where said door opens relative to said casing at an angle exceeding the angle of said tray in the first open position, wherein when said door is opened from the second closed position to the third open position in a state in which said tray is in the first open position, said tray keeps in the first open position, and wherein when said door moves from the third open position to the fourth open position, said door moves said tray from the first open position to the second open position.

2. A sheet feeding device according to claim 1, further comprising a regulating portion configured to regulate a position relative to an open direction of said tray, wherein said door includes a contact portion contacting said regulating portion when said door moves from the third open position to the fourth open position in the state in which said tray is in the first open position, and wherein said tray moves together with said door from the first open position to the second open position by contact of said contact portion to said regulating portion.

3. A sheet feeding device according to claim 2, wherein said regulating portion (a) includes an engaging portion slidably engaging with a guiding passage provided on each of opposite sides of said tray with respect to a rotational axis direction and (b) is rotatably supported by said casing, wherein said guiding passage includes (a) a first guiding passage for guiding said engaging portion between the first closed position and the first open position and (b) a second guiding passage for guiding said engaging portion when said engaging portion moves toward the second open position, wherein said contact portion of said door contacts said regulating portion from above said tray when said tray is in the first open position, and wherein said engaging portion is guided from the first guiding passage to the second guiding passage by contact of said contact portion to said regulating portion.

4. A sheet feeding device according to claim 3, wherein said first guiding passage includes a first locking portion configured to lock said engaging portion and to maintain said tray in the first open position, wherein said second guiding passage includes a second locking portion configured to lock said engaging portion and to maintain said tray in the second open position, and wherein when said tray is maintained in the first open position, said engaging portion is released from a locking state by said first locking portion by contact of said contact portion to said regulating portion and is guided from said first guiding passage toward said second guiding passage.

5. A sheet feeding device according to claim 4, wherein said second guiding passage communicates with said first guiding passage and includes an allowance region which is broader than said second locking portion at a communication portion with said first guiding passage and which allows entrance of said regulating portion.

6. A sheet feeding device according to claim 4, wherein said second guiding passage branches from said first guiding passage at a branch portion, and wherein said branch portion is broader than said second locking portion and allows said regulating portion to enter said second guiding passage when the locking state of said engaging portion is released.

7. A sheet feeding device according to claim 3, wherein said tray includes a guiding member on which said first guiding passage and said second guiding passage are formed, wherein said regulating portion includes a projection projecting upward from an upper surface of said guiding member and contacting said contact portion when said door is opened relative to said casing in a case that said tray is in the first open position, and wherein said projection in provided at an engaging-side end portion with a sheet supporting portion at said regulating portion.

8. A sheet feeding device according to claim 3, further comprising an urging member configured to urge said engaging portion upward relative to said tray when said tray is in the open position.

9. A sheet feeding device according to claim 1, wherein said door includes a feeding guide forming a feeding passage along which the sheet is fed inside said casing, and wherein said door is rotatable between (a) the second closed position, (b) a jam clearance position which is an open position where said door opens relative to said casing and which is a position for permitting removal of the sheet stagnating in said feeding passage, and (c) a maintenance position which is a position where said door opens relative to said casing more than at the jam clearance position.

10. A sheet feeding device according to claim 1, wherein the first open position of said tray is a position for permitting feeding of the sheet stacked on said tray and is a position where a component part of said sheet feeding device is exchanged.

11. A sheet feeding device according to claim 1, wherein said tray and said door have a common rotation shaft.

12. An image forming apparatus comprising:

a casing;

a door rotatable relative to said casing;

a tray configured to stack a sheet thereon and rotatable between (a) a first closed position where said tray is closed to said casing, (b) a first open position where said tray opens relative to said casing at a first angle, and (c) a second open position where said tray opens relative to said casing at a second angle larger than the first angle;

a sheet feeder provided in said casing and configured to feed the sheet stacked on said tray being in the first open position; and an image forming portion provided in said casing and configured to form an image on the sheet fed by said sheet feeding device, wherein said door is rotatable between (a) a second closed position where said door is closed to said casing, (b) a third open position where said door opens relative to said casing at an angle not exceeding the angle of said tray in the first open position, and (c) a fourth open position where said door opens relative to said casing at an angle exceeding the angle of said tray in the first open position, wherein when said door is opened from the second closed position to the third open position in a state in which said tray is in the first open position, said tray keeps in the first open position, and wherein when said door moves from the third open position to the fourth open position, said door moves said tray from the first open position to the second open position.

13. A sheet feeding device comprising:

a casing;

a door rotatably provided to said casing;

a tray configured to stack a sheet thereon and rotatable between (a) a closed position where said tray is closed to said casing, (b) a first open position where said tray opens relative to said casing at a first angle, and (c) a second open position where said tray opens relative to said casing at a second angle larger than the first angle; and a sheet feeder configured to feed the sheet stacked on said tray;

a regulating portion including an engaging portion slidably engaging with said tray and configured to be rotatably supported by said casing;

an urging member configured to urge said engaging portion upward relative to said tray when said tray is in the first open position, wherein said tray includes (a) a first guiding passage for guiding said engaging portion between the closed position and the first open position and (b) a second guiding passage for guiding said engaging portion when said engaging portion moves toward the second open position, wherein said door includes a contact portion contactable to said regulating portion from above said tray when said tray is in the first open position, and wherein said engaging portion is guided from the first guiding passage to the second guiding passage by contact of said contact portion to said regulating portion.

* * * * *